United States Patent [19]

Demurjian

[11] Patent Number: 4,580,869

[45] Date of Patent: Apr. 8, 1986

[54] CONNECTOR AND METHOD OF MAKING IT

[75] Inventor: A. Charles Demurjian, Providence, R.I.

[73] Assignee: Star-Tron Corporation, Providence, R.I.

[21] Appl. No.: 175,128

[22] Filed: Aug. 4, 1980

[51] Int. Cl.[4] ..... H01R 13/502

[52] U.S. Cl. ..... 339/206 R; 29/876; 29/881; 339/218 M

[58] Field of Search ..... 339/17 C, 176 MP, 206 R, 339/210 R, 210 M, 198 E, 198 H, 218 M; 29/876, 881

[56] References Cited

U.S. PATENT DOCUMENTS

| | | | |
|---|---|---|---|
| 3,070,769 | 12/1962 | Murphy | 339/210 M |
| 3,173,732 | 3/1965 | James | 339/176 MP |
| 3,208,026 | 9/1965 | Ruehlemann | 339/176 MP |
| 3,482,201 | 12/1969 | Schneck | 339/176 MP |
| 3,920,303 | 11/1975 | Pittman et al. | 339/176 MP |
| 4,050,769 | 9/1977 | Ammon | 339/210 M |

FOREIGN PATENT DOCUMENTS

| | | | |
|---|---|---|---|
| 788287 | 12/1957 | United Kingdom | 339/210 M |
| 1317394 | 5/1973 | United Kingdom | 339/176 MP |

*Primary Examiner*—John McQuade
*Attorney, Agent, or Firm*—Charles Hieken

[57] ABSTRACT

A connector insert of insulating material having connecting pins molded therein is force-fit into a connector shell formed as a unitary structure with pin shields. The connector shell is formed with guide pin openings at each end that receive guide pins ultrasonically bonded to the connector shell formed of a thermal plastic resin. The connector is made by molding the connecting pins into the connector insert, molding the connector shell, seating the guide pins in the guide pin openings, ultrasonically bonding the guide pins to the connector shell and force-fitting the connector insert into the connector shell.

4 Claims, 10 Drawing Figures

CONNECTOR AND METHOD OF MAKING IT

The present invention relates in general to connecting and more particularly concerns a novel circuit board connector characterized by reduced capacitance between adjacent rows of pins in adjacent connectors while minimizing the risk of short circuiting pins when inserting or removing a board.

Many electronic systems typically comprise a cabinet with a number of adjacent plug-in circuit boards having a multiple pin connector at the end of each board for mating relationship with a socket carried by the cabinet. The typical prior art approach for making the connectors involved molding rows of contact pins into the plastic, attaching metal side shields outside and parallel to the rows of pins and cementing guide pins into openings in each end of the connector that engage corresponding openings in the socket.

The connectors and the method of manufacture practiced in the prior art have a number of disadvantages. The metal side shields increase the capacitance between adjacent rows of pins in adjacent connectors to increase the chances of undesired coupling between adjacent circuit boards. Furthermore, the metal shields may electrically short out right angle pins when inserting or removing a circuit board. The manufacturing process is relatively complex, costly and time consuming.

Accordingly, it is an important object of the invention to provide an improved circuit board connector.

It is another object of the invention to achieve the preceding object with an improved process of manufacture.

It is another object of the invention to achieve one or more of the preceding objects with a connector that negligibly increases the capacitance between adjacent rows of pins in adjacent connectors and avoids electrically shorting right angle pins when inserting or removing a circuit board.

It is another object of the invention to achieve one or more of the preceding objects while facilitating secure, correct and quick insertion of connector guide pins.

According to the invention, there is connector insert means of insulating material having connecting pins molded therein, and connector shell means formed as a unitary structure with pin shields for accommodating the connector insert means. The connector insert means is forcefit in the connector shell means. Preferably, the connector shell means is formed with guide pin openings at each end for receiving guide pins. Preferably, the connector shell means is formed of a thermoplastic resin, and the guide pins ultrasonically bonded to the connector shell means seated in the guide pin openings.

The process according to the invention includes the steps of molding the connecting pins into the connector insert means, molding the connector shell means, seating the guide pins in the guide pin openings, ultrasoncially bonding the guide pins to the connector shell means and forcefitting the connector insert means into the connector shell means.

Numerous other features, objects and advantages of the invention will become apparent from the following specification when read in connection with the accompanying drawing in which.

Figure 1:
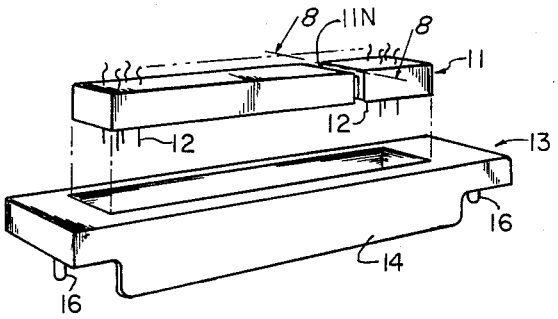
FIG. 1 is a perspective exploded view of an embodiment of the invention with the connector insert shown above the connector shell.
Figure 2:
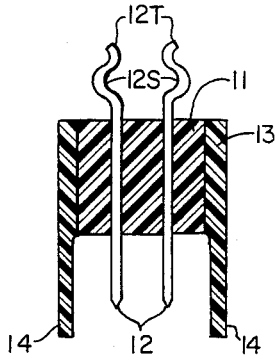
FIG. 2 is a sectional view through section 2—2 of FIG. 3 of a connector according to the invention in a transverse section adjacent to a pair of pins.

With reference now to the drawing, and more particularly FIG. 1 thereof, there is shown an exploded perspective view of an embodiment of the invention. The connector comprises a connector insert 11 of insulating material formed as a unitary structure with pins, such as 12, molded therein. Connector insert 11 is preferably forcefit into connector shell 13, preferably made of insulating material, such as thermoplastic resin, and formed as a unitary structure with insulating side shields 14 beside the two rows of pins, as best seen in FIG. 2, preferably extending just below the tips of pins 12. The insert 11 may be additionally or alternatively bonded chemically or mechanically to shell 13.

Figure 3:
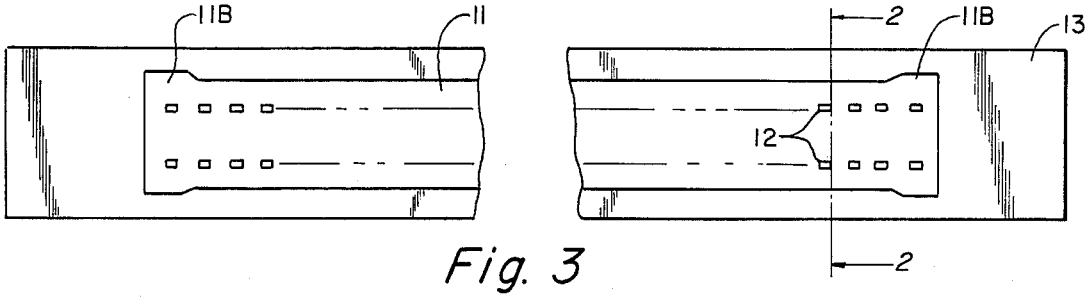
FIGS. 3, 4 and 5 are top, side and bottom views, respectively, with the middle portion cut away, of a preferred embodiment of the invention.

Referring to FIG. 2, there is shown a transverse sectional view through section 2—2 of FIG. 3. The same reference symbols identify corresponding elements throughout the drawing. The exposed tops 12T of pins 12 may receive a connecting lead from a circuit board to which the connector is attached.

Referring to FIG. 3, there is shown a top view of the connector according to the invention with the midportion cut away. Insert 11 is preferably formed with bosses 11B at each end for snug accommodation in mating recesses in connector shell 13.

Figure 4:
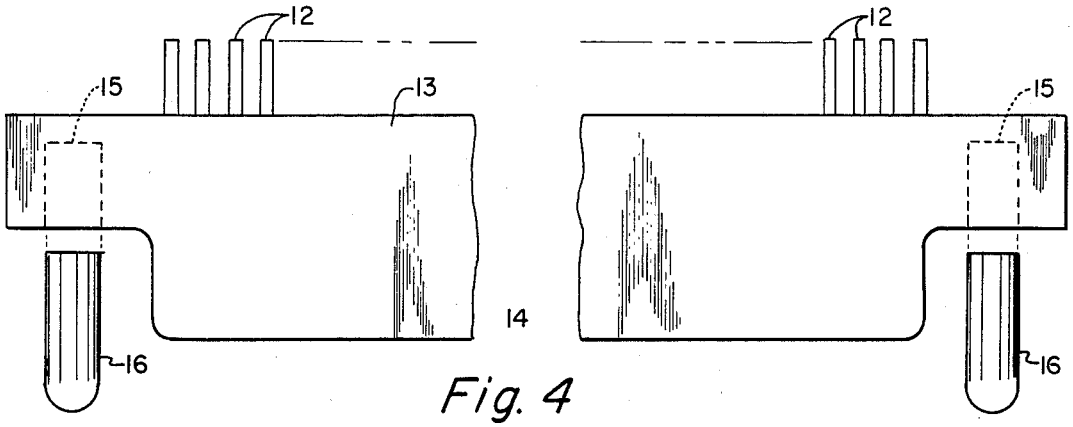

Referring to FIG. 4, there is shown a side view of the connector of FIG. 3 with the midportion cut away. Connector shell 13 is formed with openings 15 at each end for accommodating guide pins 16 shown exploded from the connector shell in FIG. 4.

Figure 5:
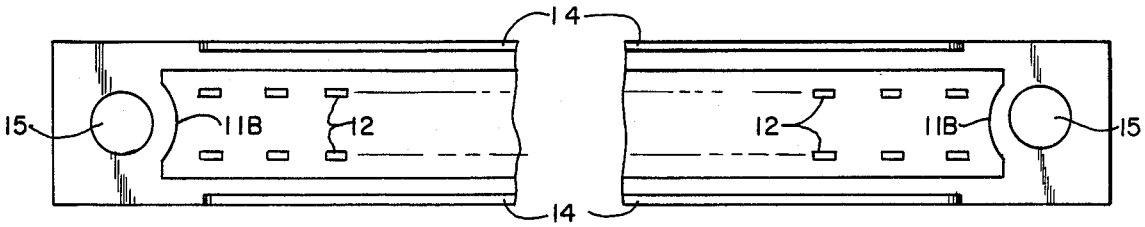

Referring to FIG. 5, there is shown a bottom view of the connector of FIGS. 3 and 4 showing how boss 11B terminates concavely at the bottom to facilitate a snug forcefit when insert 11 is pressed downward into connector shell 13.

Figure 8:
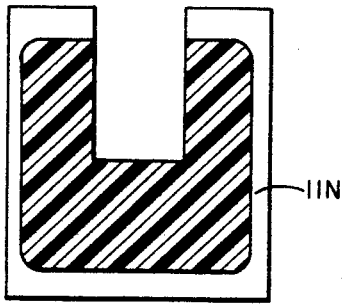
FIG. 8 is a view through section 8—8 of FIG. 1 to illustrate the groove for accommodating the crossover contact of FIG. 9.
Figure 9:
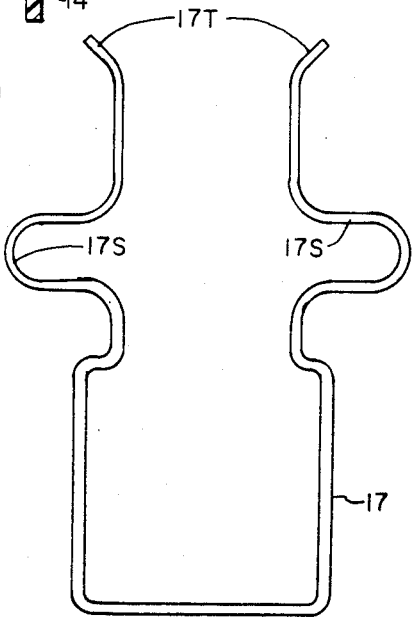
FIG. 9 is an end view of a crossover contact according to the invention.

Furthermore, the insert 11 may be formed with a notch 11N around its perimeter as best seen in FIG. 8 for accommodating crossover contacts, such as 17, best seen in FIG. 9.

The crossover connectors, such as 17, are especially advantageous for interconnecting terminals on opposite sides of a densely packed circuit board at ends 17T of the crossover connector. The crossover connector preferably is formed with stress relief portions 17S. The molded-in contacts are also preferably formed with stress relief portions 12S. These stress relief portions are advantageous when the connectors are soldered to the fingers of substrates, either on laminated or ceramic boards, having a different thermal coefficient from that of the connector insert 11 so that the fingers of the substrate may rise and fall relative to insert 11 without introducing potentially damaging stress.

The crossover contacts 17 are snapped into respective notches 11N before insert 11 is seated in a connector shell 12. When the insert is seated in the shell, each crossover contact 17 is mechanically secure and electrically insulated from the other pins to provide a convenient means for interconnecting opposite sides of the circuit board. This mode of connection is especially advantageous where it is desired to avoid forming openings in heat sinks that would reduce the effectiveness of the heat sink in withdrawing heat from circuit components.

A connector may have any number of parallel rows with any number of pins in each row. One connector has 20 pins in each of two parallel rows. The specific embodiment illustrated shows in-line pins adapted to be connected to the circuit board with the pins aligned along the length of the board.

Figure 6:
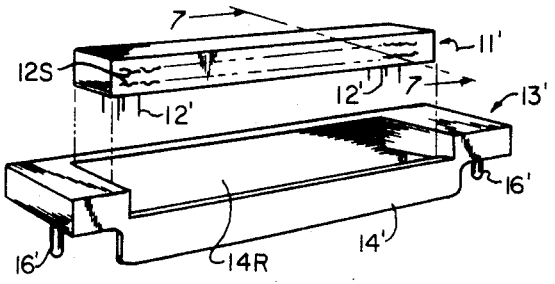
FIG. 6 is a perspective exploded view of an embodiment of the invention with right-angle pins.
Figure 7:
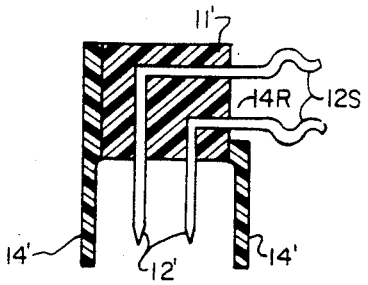
FIG. 7 is a view through section 7—7 of FIG. 6.
Figure 7A:
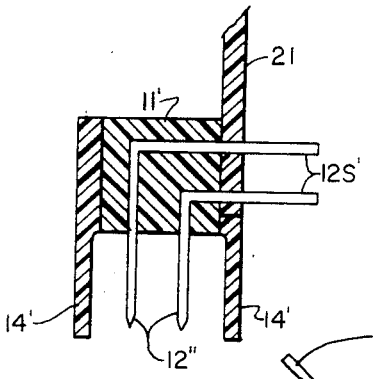
FIG. 7A is a sectional view through a modification.

Referring to FIG. 6, the invention is also applicable for use with connectors attached to the circuit board with the plane of the shields 14' perpendicular to the plane of the circuit board. The pins are then bent at the top at right angles to the plane of the pins to form corresponding rows of pin tops spaced by essentially the thickness of the circuit board with connector shell 13' formed with a sidewall above a shield 14' having a recess 14R for exposing the side tips such as 12S of pins 12', as best seen in FIG. 7, a sectional view through section 7—7 of FIG. 6. FIG. 7A is a sectional view of a modification with printed circuit board 21 mounted perpendicular to and soldered to straight side tips 12S' of leads 12''.

The process according to the invention includes molding the connector inserts 11 with the pins 12 seated therein and formed with bosses 11B. Mold the connector shells 13 with the shields 14, channels for accepting bosses 11B and with an opening at each end for accepting the guide pins. Guide pins 16 may then be inserted in openings 15 and ultrasonically bonded thereto. Insert 11 may then be snapped into connector shell 13 to be force fit therein.

The invention has a number of advantages over the prior art approach that used metal side shields fastened to the plastic insulator containing the pins and guide pins. Fastening guide pins and side shields to the plastic with an epoxy is costly, time-consuming and difficult. Furthermore, the metal shields reduce the capacity between adjacent rows of pins in adjacent connectors and might short circuit exposed pins of adjacent right angle connectors when the attached circuit board is inserted or removed. Furthermore, the shields will separate if the epoxy bond released. The present invention is a more effective insulator, the plastic shields will not electrically short pins and the pin shield portions 14 will remain in position. Many types of insulating material may be used within the principles of the invention. Thermoplastic resins are especially advantageous, especially for connector shell 13 to facilitate ultrasonically bonding guide pins 16 to the connector shell. A suitable material is diallyl phthalate thermosetting compound.

Although it is preferred that connector shell 13 be of insulating material, a number of features of the invention may be attained if the connector shell 13 is formed of metal or other conducting material. The guide pins 16 would preferably be forcefit into connector shell 13. A conducting connector shell may be desirable in certain applications where electrical shielding of the pins is desired, and the conducting shell would then typically be grounded.

There has been described novel apparatus and techniques for improved connecting. It is evident that those skilled in the art may now make numerous uses and modifications of and departures from the specific embodiments described herein without departing from the inventive concepts. Consequently, the invention is to be construed as embracing each and every novel feature and novel combination of features present in or possessed by the apparatus and techniques herein disclosed and limited solely by the spirit and scope of the appended claims.

What is claimed is:

1. Electrical connecting apparatus comprising, mating connector insert means formed with insulatedly separated molded-in conducting pins and connector shell means, said connector shell means formed as a unitary structure with a central longitudinal slot for accommodating said mating connector insert means, said connector insert means of insulating material for carrying said insulatedly separated conducting pins and being forcefit in said longitudinal slot, wherein said connector shell means is a unitary structure formed with side plate means along opposite sides of said longitudinal slot for protecting said pins, wherein said connector shell means is of insulating material, wherein a notch is formed between said connector insert means and said connector shell means in a section about the perimeter of said connector insert means for accommodating crossover connecting means, and said crossover connecting means seated in said notch for interconnecting opposite sides of a circuit board.

2. Electrical connecting apparatus in accordance with claim 1 wherein said crossover connector means is formed with strain relief portions for allowing circuit board connecting fingers connected thereto to move relative to said apparatus in the presence of temperature variations.

3. A method of making the electrical connecting apparatus comprising mating connector insert means formed with insulatedly separated molded-in conducting pins and connector shell means, said connector shell means formed as a unitary structure with a central longitudinal slot for accommodating said mating connector insert means, said connector insert means of insulating material for carrying said insulatedly separated conducting pins and being force fit in said longitudinal slot with a notch formed between said connector insert means and said connector shell means in a section about the perimeter of said connector insert means for accommodating crossover connecting means with said crossover connecting means seated in said notch for interconnecting opposite sides of a circuit board which method includes the steps of molding said connector insert means with said pins seated therein and said at least one notch therein about the connector insert perimeter, forming said connector shell means, snapping said crossover connecting means into said notch, and seating said connector insert means into said longitudinal slot to establish a secure force-fit therebetween with said crossover connecting means securely seated therein.

4. A method in accordance with claim 3 and further including the step of molding said connector shell means of thermoplastic resin formed with guide pin openings separated by the length of said longitudinal slot, inserting guide pins into said guide pin openings, and ultrasonically bonding said guide pins to said connector shell means.

* * * * *